US005987869A

United States Patent [19]

Meier et al.

[11] Patent Number: 5,987,869

[45] Date of Patent: Nov. 23, 1999

[54] DEBRIS REMOVAL DEVICE FOR AN OPEN-END SPINNING MACHINE WITH A PLURALITY OF SPINNING UNITS

[75] Inventors: Wolfgang Meier, Jüchen; Bert Schlömer, Heinsberg; Ralf Siewert; Thomas Weide, both of Mönchengladbach, all of Germany

[73] Assignee: W. Schlafhorst AG & Co., Germany

[21] Appl. No.: 08/936,397

[22] Filed: Sep. 25, 1997

[30] Foreign Application Priority Data

Oct. 1, 1996 [DE] Germany ..... 196 40 546

[51] Int. Cl.[6] ..... D01H 11/00

[52] U.S. Cl. ..... 57/301; 57/304; 57/406; 57/407; 57/411

[58] Field of Search ..... 57/301, 304, 406, 57/407, 408, 411, 412

[56] References Cited

U.S. PATENT DOCUMENTS

| | | | |
|---|---|---|---|
| 3,777,329 | 12/1973 | Lane | 57/301 |
| 3,924,397 | 12/1975 | Stahlecker et al. | 57/301 |
| 3,959,961 | 6/1976 | Stahlecker | 57/301 |
| 3,986,328 | 10/1976 | Harrap | 57/301 |
| 4,162,556 | 7/1979 | Van Ditshuizen et al. | 57/301 |
| 4,183,201 | 1/1980 | Stahlecker | 57/301 |
| 5,611,195 | 3/1997 | Lovas et al. | 57/301 |
| 5,732,543 | 3/1998 | Bungter et al. | 57/301 |

FOREIGN PATENT DOCUMENTS

| | | |
|---|---|---|
| 26 34 770 B2 | 2/1978 | Germany . |
| 21 59 286 C3 | 2/1982 | Germany . |
| 24 58 538 C2 | 7/1982 | Germany . |
| 36 40 001 C2 | 6/1995 | Germany . |
| 195 29 654 A1 | 2/1997 | Germany . |
| 547 873 | 4/1974 | Switzerland . |
| 610 941 A5 | 6/1975 | Switzerland . |

OTHER PUBLICATIONS

Schlafhorst/Autocoro publication entitled "Spinnbox," pp. 1.3.0, 1.3.1, 1.3.2, 1.3.3 and 1.3.20.

*Primary Examiner*—William Stryjewski
*Attorney, Agent, or Firm*—Kennedy Covington Lobdell & Hickman

[57] ABSTRACT

A mechanically operating debris removal device for an open-end spinning machine 1 comprises a guide conduit arranged below the spinning units and enclosing a debris conveyor belt. The guide conduit comprises a base and a cover, which may be pivotable or detachable relative to the base. During spinning operation, the base and the cover form an essentially closed belt guide conduit. Debris passage openings are formed in the cover with associated air and debris guide deflectors to communicate with debris exit openings in the sliver opening devices. The upper run of debris conveyor belt creates a slight suction flow in guide conduit and at the debris passage openings to prevent fine debris from settling in the area of the debris passage openings and in the area of debris exit openings of the sliver opening devices.

13 Claims, 5 Drawing Sheets

DEBRIS REMOVAL DEVICE FOR AN OPEN-END SPINNING MACHINE WITH A PLURALITY OF SPINNING UNITS

FIELD OF THE INVENTION

The present invention relates generally to open-end spinning devices and methods and, more particularly, to a debris removal device for use in a fiber opening device of an open-end spinning unit.

BACKGROUND OF THE INVENTION

In open-end spinning machines, such as are described, e.g., in the handbook "Autocoro" of W. Schlafhorst & Co., a sliver is supplied between a drawing-in roller and a feeding trough to be separated into its individual constituent fibers by an opening cylinder. Debris particles and waste fibers are also separated to a great extent in this process. The opening cylinder transports all such components over a fiber guide surface into the area of a debris exit opening. During this transport, the fibers as well as the debris particles and other waste are accelerated by the opening cylinder and by a current of air circulating with the opening cylinder in very short time period to approximately the circumferential speed of the opening cylinder. The particles having a minimal mass, that is, fibers and debris particles, thereby have the tendency to leave the circular path tangentially as a consequence of the centrifugal force acting on them as soon as the mechanical guidance is interrupted in the area of the debris exit opening of the opening-cylinder housing.

A debris removal device, e.g., in the form of an endless circulating debris conveyor belt, is arranged immediately below the debris exit opening. In order to prevent spinnable fibers from separating from the opening cylinder in the area of the debris exit opening along with the debris particles the debris exit opening is also designed to serve as a intake opening for air to enter into the opening-cylinder housing under the suction or negative pressure conditions created by the rotating opening cylinder. The fibers have a relatively large specific surface area in relation to their relatively low mass. Thus, this air current is directed onto the opening cylinder and thereby pneumatically holds the fibers against and guides them along the opening cylinder. On the other hand, the debris particles, which have a distinctly higher kinetic energy on account of their larger mass, overcome this air current and are cast away tangentially through the debris exit opening onto the debris conveyor belt running therebelow. The debris conveyor belt subsequently transports the separated debris particles to a suction apparatus located at an end of the machine, where they are discarded.

Such mechanical debris removal devices of open-end rotor spinning machines usually consist, as already indicated above, of a guide conduit which runs below the spinning units, is open at the top and in which a debris conveyor belt is guided. The guide conduit is covered in the area of the spinning positions by a cover member of the spinning units. Disadvantageously, however, the debris particles passing through the debris exit openings of the spinning units, especially the lighter weight debris particles, often collect behind these cover elements, which can not be recognized from the outside and also can not be eliminated during the spinning operation.

It has therefore already been suggested that the spinning units be modified in such a manner that the usual cover elements be entirely eliminated or shortened to a sufficient extent that the area of the debris exit openings of the sliver opening devices of the spinning units are readily visible to an operator and can be cleaned from the outside of the machine.

Such spinning units with a readily accessible debris exit area as well as with an associated cleaning device arranged on an automatic service traveler are described in subsequently published German Patent Application P 195 29 654.0. However, in actual practice, even spinning units designed in this manner have a relatively strong tendency to become contaminated. In particular, the open guide conduit of these debris removal devices has proved to be problematic.

Swiss Patent CH 547,873 teaches an open-end spinning machine whose pneumatic debris removal device comprises an essentially closed outlet conduit running the length of the machine. The outlet conduit comprises upper air intake bores in the area of the spinning positions which are closed by a traveling sealing belt into which regulating bores are formed. Thus, in this apparatus the sliver opening devices of the individual spinning positions are successively loaded with suction air via the regulating bores of the sealing belt. Such an apparatus results in a discontinuous removal of debris, which on the whole is not very satisfactory.

A combination of mechanical and pneumatic debris removal is described in German Patent Publication DE-AS 26 34 770. This known device utilizes a rotating debris conveyor belt guided in an open guide conduit for removing coarse debris components and a suction conduit arranged below the debris conveyor belt for receiving the finer debris components. The suction conduit comprises a through slot on its surface which is sealed by the debris conveyor belt. Regulating bores are also arranged in the debris conveyor belt in this device so that, as in the device according to Swiss Patent CH 547,873, the sliver opening devices of the individual spinning positions are successively loaded with suction air. In particular, the discontinuous loading with suction air is supposed to remove the lighter debris components and therewith avoid damaging flocculations. However, the described device has not become accepted in practice.

SUMMARY OF THE INVENTION

In view of the above state of the art, it is an object of the present invention to provide an improved debris removal device for open-end spinning machines having plural adjacent spinning positions which will substantially overcome the disadvantages of the prior art.

The invention addresses this problem by providing an improved debris removal device for an open-end spinning machine of the type having a plurality of adjacent spinning positions each comprising a sliver opening device including an opening cylinder rotating in an opening-cylinder housing formed with a debris exit opening for discharge therethrough of impurities freed during sliver opening. Basically, the debris removal device comprises a substantially enclosed guide conduit for disposition below the debris exit openings of the opening devices of the spinning machine, the guide conduit having a plurality of debris passage openings for communication respectively with the debris exit openings of the sliver opening devices, and a debris removal belt arranged for travel within the guide conduit.

The design in accordance with the present invention of a debris removal device with an essentially closed guide conduit has the advantage that both the coarser as well as the finer debris components are reliably removed simultaneously and continuously by the mechanical debris conveyor belt. An air current is produced in the guide conduit in the direction of travel of the upper run of the debris conveyor belt by its continuous traveling movement in the guide conduit during the spinning process. This air current within the guide conduit results in an injector-like effect in the area of the debris passage openings, i.e., a gentle suction flow directed into the guide conduit constantly prevails in the area of the debris passage openings. This suction flow reliably prevents the finer debris components separated out of the sliver from settling in the area of the debris exit openings of the sliver opening device and/or in the area of the debris passage openings of the debris removal device to form floc thereat.

It has proven to be especially advantageous in this connection if the cover element comprises air and debris guide deflectors or baffles respectively disposed adjacent the debris passage openings of the guide conduit, with each air and debris guide deflector disposed at a rearward side edge of a respective debris passage opening as viewed in the direction of transport of the debris removal belt. Each air and debris guide deflector preferably comprises an inclined back wall and two approximately triangular side walls.

The guide conduit itself in the preferred embodiment comprises a base and a cover element substantially enclosing the base, with the debris passage openings being formed in the cover element. The guide conduit preferably has an overall U-shape facing the opening devices. The guide conduit components, i.e., the base and the cover element, are preferably manufactured from sheet metal or other plate stock since such materials can be readily and economically fashioned into desired shapes by bending and since components thusly manufactured also have a relatively high rigidity.

In one embodiment, the base of the guide conduit defines an open side of the base facing the debris exit openings of the sliver opening devices and the cover element is pivotable with respect to the base for selectively enclosing the base, preferably toward the front of the machine. Thus, the guide conduit is accessible over its entire length and its full height from the front when the closure element is folded downward or outward in the open state. Consequently, maintenance or repair both of the upper side as well of the lower side of the debris removal device is readily possible when needed. An expensive disassembly of the debris removal device thereby is unnecessary.

In a further embodiment, the base of the guide conduit is preferably of a U-shaped configuration defining an open side of the base facing the debris exit openings of the sliver opening devices and the cover element is detachably mountable on the base for selectively enclosing the base.

Further features and details of the present invention are described and will be understood from the following disclosure of the preferred embodiments and with reference to the accompanying drawings.

DESCRIPTION OF THE PREFERRED EMBODIMENTS

Figure 1:
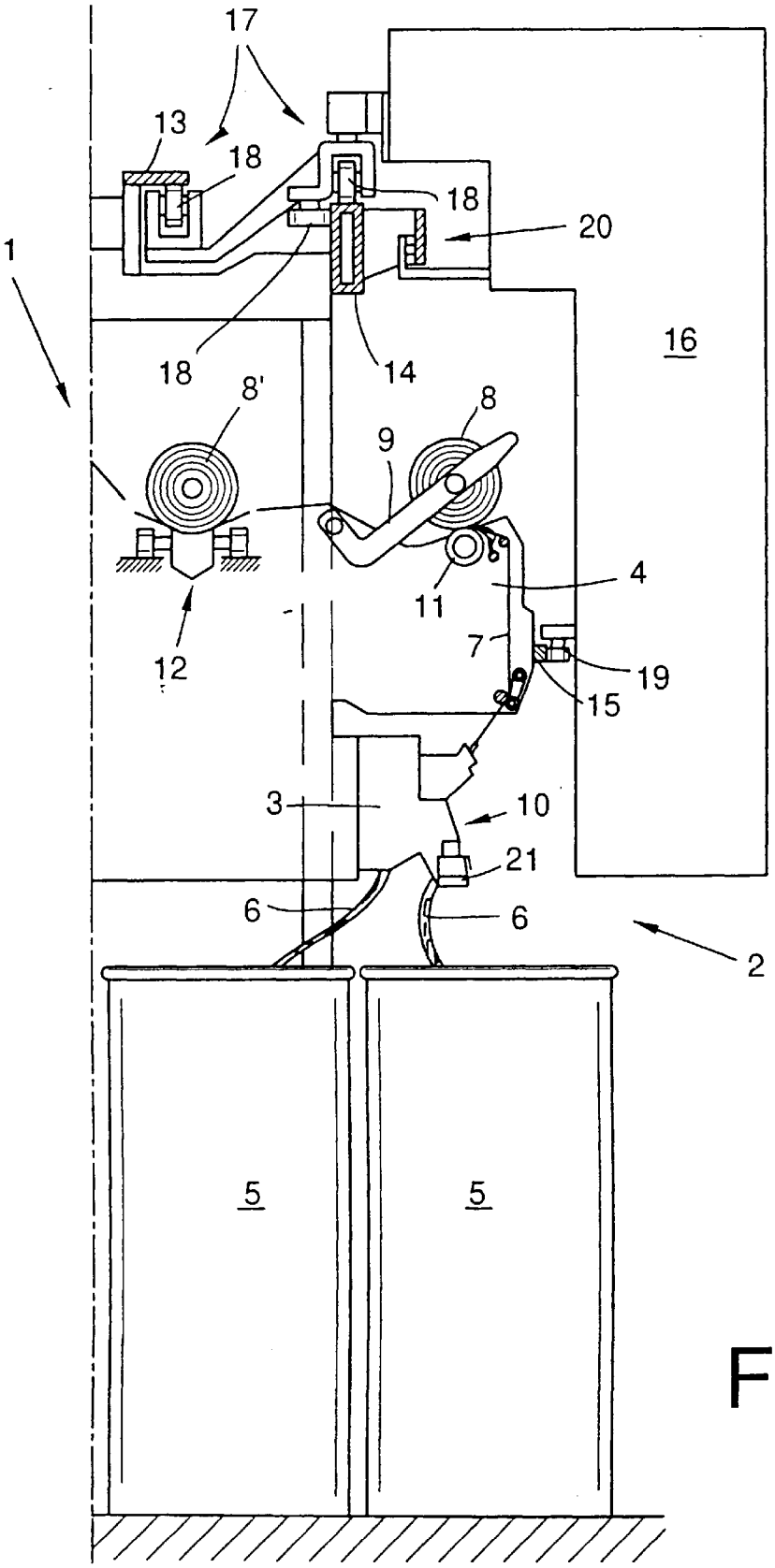
FIG. 1 is a schematic end elevational view of one-half of an open-end spinning machine with a debris removal device in accordance with the present invention.

Referring now to the accompanying drawings and initially to FIG. 1, an open end spinning machine 1 having a plurality of spinning stations 2 arranged side-by-side and back-to-back along both sides of the machine is schematically illustrated in end elevation with a debris removal device in accordance with the present invention arranged below the spinning stations, only one half of the machine depicting one spinning station 2 being illustrated for sake of simplicity and clarity of illustration.

Each spinning position 2 is equipped with a spinning unit 3 and a yarn winding device 4. In each spinning unit 3, a sliver 6 stored in and delivered from a spinning can 5 is opened into its constituent fibers by an opening device 10 which are then spun into a yarn 7 and the yarn is subsequently wound by the winding device 4 into a cross-wound bobbin 8 (or 8'). As is shown, each winding device 4 is provided with creel 9 for rotatably holding an empty tube to form the cross-wound bobbin 8 and with a winding drum 11 for surface driving rotation of the cross-wound bobbin via frictional peripheral contact therewith. As more fully described below, a mechanical debris removal device 21 is disposed below the sliver opening devices 10 of the aligned spinning stations 2 along each side of the machine.

The open-end spinning machine 1 furthermore comprises a traveling tube and bobbin transport device 12 for supplying empty tubes to, and removing finished cross-wound bobbins from, the spinning stations of the spinning machine.

A traveling service device 16 is arranged at or supported on the spinning machine for travel along the plural spinning stations on guide rails 13, 14 as well as a support rail 15. The drive assembly of this service traveler 16 comprises rollers 18 and a support wheel 19. The service traveler 16 is supplied with electric energy from the spinning machine via a sliding contact device 20. Such service travelers 16 constantly patrol along the open-end spinning machine 1 and engage automatically when there is a need for service at one of work positions 2, for example, if a yarn break has occurred at a work position 2 or if a cross-wound bobbin has reached its prescribed diameter at one of the work positions and must be replaced by an empty tube.

In such an instance, the service traveler 16 moves to the particular spinning position, positions itself thereat and, in case of a yarn break, locates the torn yarn end lying on the circumferential surface of cross-wound bobbin 8 with a yarn search jet (not shown). After the spinning unit has been cleaned, the yarn end is re-pieced within the spinning unit to a ring of fibers rotating therein.

The working members necessary for the re-piecing of the yarn and the cleaning of the spinning unit are known and do not constitute the subject matter of the present invention. Therefore, these devices are not shown in FIG. 1 for reasons of greater clarity.

Figure 2:
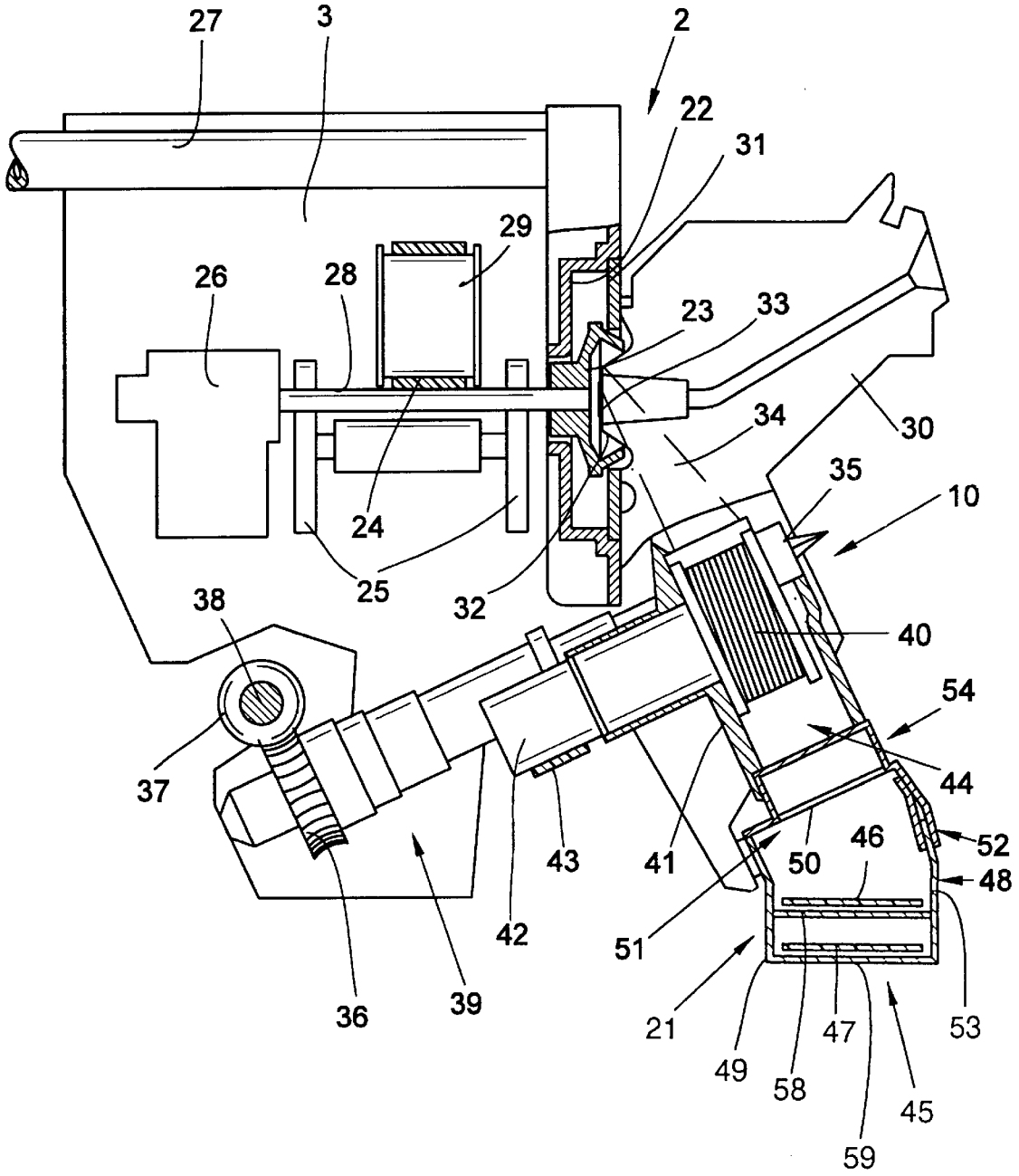
FIG. 2 is a side elevational view, partially in section, of a spinning unit on an enlarged scale, illustrating a first embodiment of the guide conduit of the present debris removal device.

FIG. 2 shows on an enlarged scale one spinning unit 3 with its associated sliver opening device 10 and debris removal device 21. Each spinning unit 3 comprises more specifically a spinning rotor 23 rotatably supported in a rotor housing 22 for receiving the fibers individualized in the sliver opening device 10 and centrifugally spinning the fibers into a yarn 7. The interior of the housing 22 is connected via a suction line 27 to a vacuum source (not shown). The spinning rotor is mounted on a rotor shaft 28 supported in conventional manner in a wedge-like area between two pair of support disks 25. The rotor shaft 28 is held in engagement with the support disks 25, as is customary, by the lower side of a tangential belt 24 trained about a pressure roller 29.

The forward side of the rotor 23 is open and the rotor housing 22 is also open at its forward side outwardly about the rotor 23, the spinning unit 3 having a hood 30 having an extension 32 which projects into the rotor 23 and a conduit plate 31 outwardly thereof for closing the forward side of the rotor 23 and the housing 22 during spinning operation. The hood 30 is formed angularly with a fiber guide conduit 34 extending from the opening device 10 to a mouth opening through the extension 32 into the rotor 23 to feed individualized fibers into the rotor 23 and a yarn draw-off nozzle 33 extends centrally through the extension 32 and outwardly therefrom through the hood 30 for withdrawal therethrough of the yarn 7 spun in the rotor 23.

The sliver opening device 10 comprises a sliver drawing-in roller 35 supported on one end of a shaft connected through an selectively switchable electrocoupling 39 with a worm gear 36 arranged in meshing engagement with a worm 37 on a drive shaft 38 extending longitudinally along the machine for driving the drawing-in roller 35. The sliver opening device further comprises an opening cylinder 40 rotatably driven within a housing 41 via a tangential belt 43 engaged with a wharve 42 mounted coaxially with the cylinder 40. The opening-cylinder housing 41 is connected at one side with the rotor housing 22 via the fiber guide conduit 34 therebetween and at another side with the debris removal device 21 via a debris exit opening 44 in the housing 41.

Figure 3:
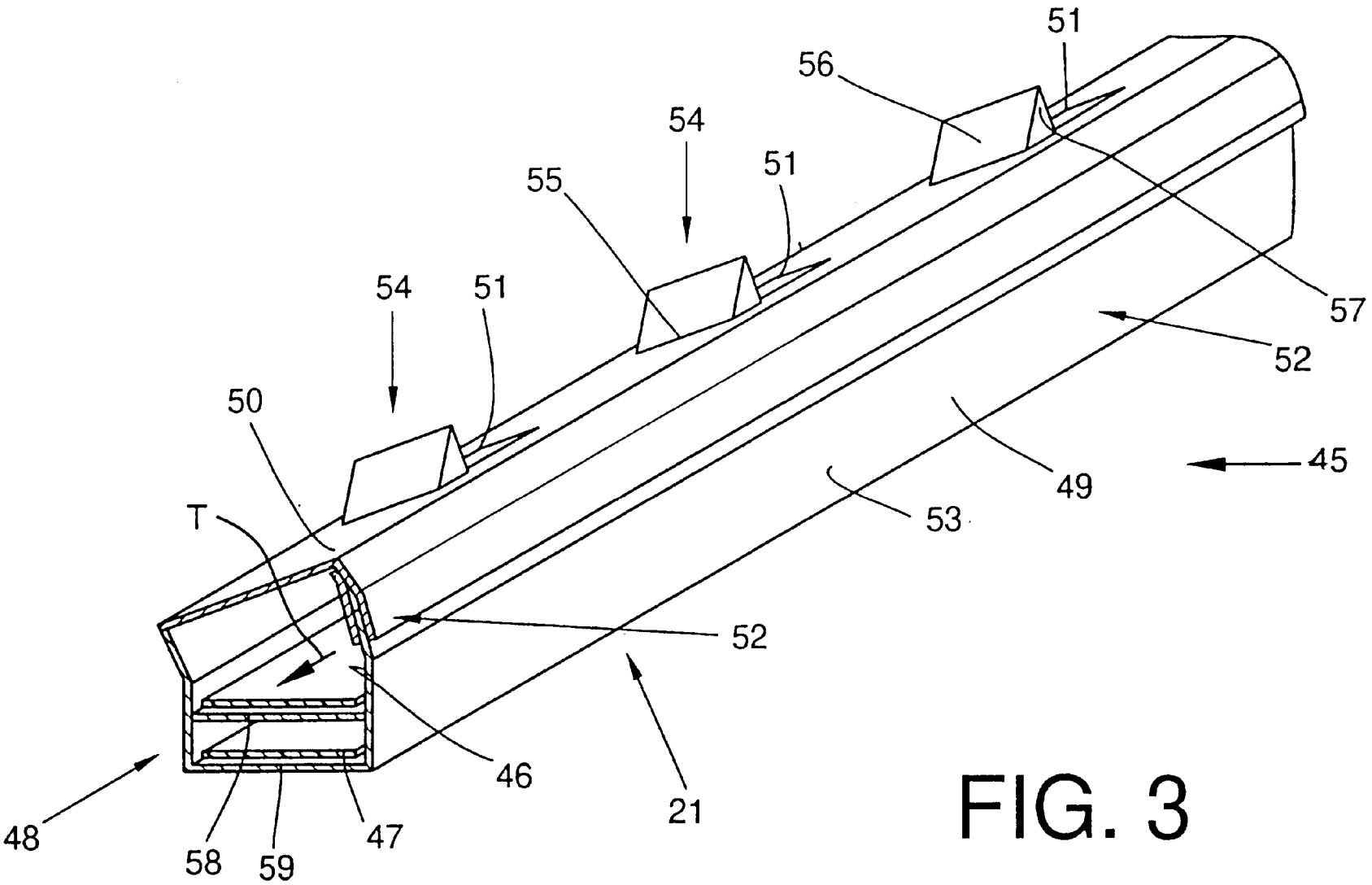
FIG. 3 is a perspective view of the guide conduit of FIG. 2.

The debris removal device 21 comprises a guide conduit 45 in which upper and lower runs 46, 47 of an endless rotating debris removal conveyor belt 48 are guided. As FIGS. 2 and 3 show, the guide conduit 45 includes a U-shaped base 49 which can be fixed to the spinning units 3 or to appropriate fastening devices of the OE spinning machine to open in the direction of sliver opening device 10 with the open side of base 49 being closed by one or more cover elements 50 into which debris passage openings 51 are formed, thereby providing the guide conduit 45 with a profile which is essentially closed on all sides. The cover elements 50 are connected to the base 49 in a readily detachable manner, including hook-like connection elements 52 which engage the front leg 53 of the base 49.

Air and debris deflectors 54 are mounted adjacent the debris passage openings 51 of the cover elements 50. These deflectors 54 are disposed at the rearward sides 55 of the debris passage openings 51, as viewed relative to the direction of transport T of the debris conveyor belt 48, and comprise an inclined back wall 56 and of two triangular side walls 57.

Figure 4:
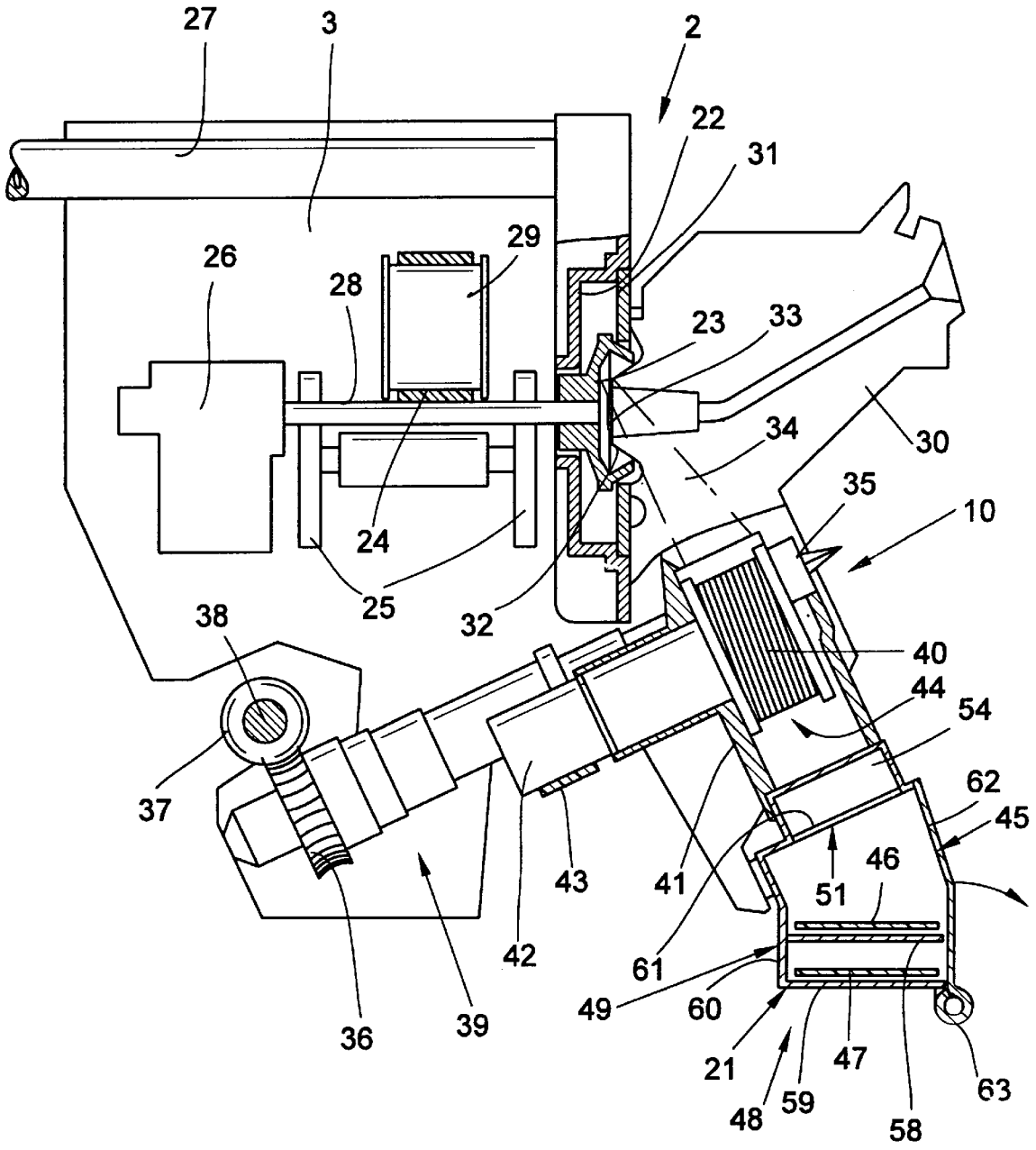
FIG. 4 is an enlarged side elevational view of a spinning unit, partially in section, similar to that of FIG. 2, illustrating a second embodiment of the guide conduit of the present debris removal device.
Figure 5:
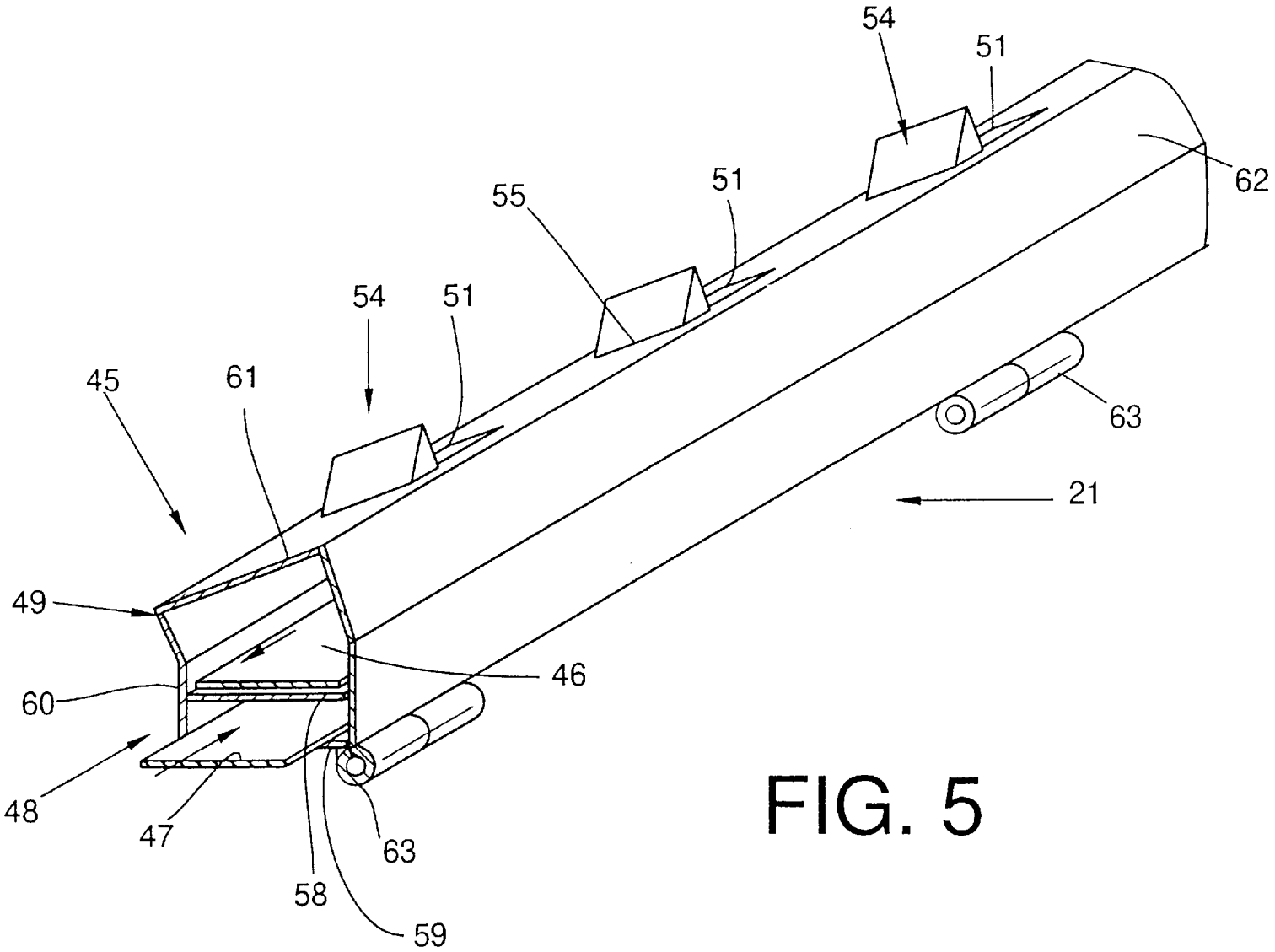
FIG. 5 is a perspective view of the guide conduit of FIG. 4.

FIGS. 4 and 5 show another embodiment of debris removal device 21 according to the present invention. This embodiment is largely similar to that of FIGS. 1–3 except that the guide conduit 45 fixed to the spinning units 3 comprises a base 49 formed of a one-piece rear connection wall 60 by which the base 49 can be fixed to spinning units 3 and a one-piece front wall 61 connected via hinges 63 to the rear wall 60 to form a pivotable flap 62 which is normally closed during operation of the machine to form a fully closed guide conduit 45 defining guide paths for the upper and lower runs 46, 47 of the debris conveyor belt 48, but can be selectively folded open, preferably in the direction of the service passage of the textile machine so that, if necessary, the debris conveyor belt 48 can be reached for service. Debris passage openings 51 with air and debris guide deflectors 54 are arranged in the upper surface of the front wall 61, in the same manner as that of the exemplary embodiment of FIGS. 2 and 3.

The operation of the debris removal device 21 of the present invention may thus be understood. The upper run 46 of the debris conveyor belt 48, which constantly travels during the spinning operation in direction of transport T, generates an air current inside the guide conduit 45 in the same direction as the upper run travels. As a result of this air current, a slight vacuum is produced in the area of debris passage openings 51, which results in a suction flow directed into the guide conduit 45. This relatively gentle suction flow assures that the debris exit openings 44 of the sliver opening devices 10, the debris passage openings 51 in the guide conduit 45 and also the areas adjacent thereto are kept free to a great extent from the lightweight debris components which have been a problem in the prior art.

Those persons skilled in the art will understand that the present invention is not limited to the exemplary embodiments shown, but as concerns the structure and design of the guide conduit of the debris removal device, particularly as regards the form and arrangement of the base, the associated closure elements, the debris passage openings and the associated air and debris guide deflectors, further variants are absolutely conceivable without deviating from the fundamental concept of the invention. It is important in the present invention that the guide conduit containing the upper run of a traveling debris conveyor belt be substantially closed, except for debris passage openings in the area of the respective spinning positions, so that a suction flow directed into the guide conduit develops in the area of the debris passage openings.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A debris removal device for an open-end spinning machine having a plurality of adjacent spinning positions each comprising a sliver opening device including an opening cylinder rotating in an opening-cylinder housing formed with a debris exit opening for discharge therethrough of impurities freed during sliver opening, the debris removal device comprising:

a guide conduit for disposition below the debris exit openings of the opening devices of the spinning machine, the guide conduit having a plurality of debris passage openings for communication with an interior of said guide conduit and disposed in a side of said guide conduit for orientation toward the debris exit openings for communication respectively with the debris exit openings of the sliver opening devices, and a debris removal belt arranged for travel within the interior of said guide conduit and including an upper run disposed at a spacing from said side having said debris passage openings whereby said debris passage openings are disposed in constant open communication with the interior of said guide conduit and said debris removal belt, and whereby constant travel of said debris removal belt within said guide conduit creates a constant debris removal air flow through said debris passage openings into the interior of said guide conduit.

2. The debris removal device according to claim 1, wherein said guide conduit comprises a base and wherein said side in which said debris opening passages are disposed comprises a cover element substantially enclosing said base, said debris passage openings being formed in said cover element.

3. The debris removal device according to claim 2, wherein said base of said guide conduit is u-shaped and said cover element is pivotable with respect to said base for selectively enclosing said base.

4. The debris removal device according to claim 2, wherein said base of said guide conduit is u-shaped and said cover element is detachably mountable on said base for selectively enclosing said base.

5. The debris removal device according to claim 2, wherein said cover element comprises air and debris guide deflectors respectively disposed adjacent said debris passage openings of said guide conduit.

6. The debris removal device according to claim 5, wherein each said air and debris guide deflector is disposed at a rearward side edge of a respective said debris passage opening as viewed in the direction of transport of said debris removal belt.

7. The debris removal device according to claim 6, wherein each said air and debris guide deflector comprises an inclined back wall and two approximately triangular side walls.

8. The debris removal device according to claim 1, wherein said guide conduit is fabricated of plate-like components.

9. The debris removal device according to claim 1, wherein said debris removal belt includes a lower run and wherein said upper run and said a lower run are arranged for travel within and are enclosed by said guide conduit.

10. The debris removal device according to claim 1, wherein except for said debris passage openings said guide conduit is enclosed and forms an air-tight conduit along its length for creation of the debris removal air flow by travel of said debris removal belt.

11. An open-end spinning machine including the debris removal device according to claim 1, wherein said debris opening passages are disposed below and at a spacing to the debris exit openings of the opening-cylinder housings whereby ambient air flows through said debris opening passages and becomes part of the debris removal air flow.

12. A debris removal device for an open-end spinning machine having a plurality of adjacent spinning positions each comprising a sliver opening device including an opening cylinder rotating in an opening-cylinder housing formed with a debris exit opening for discharge therethrough of impurities freed during sliver opening, the debris removal device comprising:

a substantially enclosed guide conduit for disposition below the debris exit openings of the opening devices of the spinning machine, the guide conduit including a base and a cover element substantially enclosing the base and having a plurality of debris passage openings formed in the cover element for communication respectively with the debris exit openings of the sliver opening devices, and a debris removal belt arranged for travel within the guide conduit, wherein the base of the guide conduit defines an open side of the base facing the debris exit openings of the sliver opening devices and the cover element is pivotable with respect to the base for selectively enclosing the base.

13. A debris removal device for an open-end spinning machine having a plurality of adjacent spinning positions each comprising a sliver opening device including an opening cylinder rotating in an opening-cylinder housing formed with a debris exit opening for discharge therethrough of impurities freed during sliver opening, the debris removal device comprising:

a substantially enclosed guide conduit for disposition below the debris exit openings of the opening devices of the spinning machine, the guide conduit including a base and a cover element substantially enclosing the base and having a plurality of debris passage openings formed in the cover element for communication respectively with the debris exit openings of the sliver opening devices, and a debris removal belt arranged for travel within the guide conduit, wherein the cover element comprises air and debris guide deflectors respectively disposed adjacent the debris passage openings of the guide conduit, each air and debris guide deflector including an inclined back wall and two approximately triangular side walls.

* * * * *